United States Patent [19]

Wood

[11] 4,087,983

[45] May 9, 1978

[54] OFFSHORE PLATFORMS

[76] Inventor: Eric Wood, Cosy Cottage, Haggs Hill, Ossett, Yorkshire, England

[21] Appl. No.: 721,898

[22] Filed: Sep. 9, 1976

[30] Foreign Application Priority Data

Sep. 11, 1975 United Kingdom ..... 37399/75

[51] Int. Cl.[2] ..... E02D 21/00

[52] U.S. Cl. ..... 61/86; 61/95

[58] Field of Search ..... 61/95, 86–94; 248/160, 145

[56] References Cited

U.S. PATENT DOCUMENTS

| | | | |
|---|---|---|---|
| 2,683,013 | 7/1954 | Amundson et al. | 248/145 |
| 3,756,033 | 9/1973 | Kouka | 61/95 |
| 3,766,582 | 10/1973 | Lloyd et al. | 61/95 |
| 3,906,736 | 9/1975 | Van Houten et al. | 61/95 X |

*Primary Examiner*—Dennis L. Taylor

*Attorney, Agent, or Firm*—Harrington A. Lackey

[57] ABSTRACT

An offshore platform support structure having a column structure including at least two sections, each section being joined to a vertically adjacent section by a plurality of circumferentially arranged joints defining a plurality of hinge axes lying in a plane substantially normal to the vertical axis of the column structure, to permit yielding tilting about any one of the hinge axes in response to excessive lateral forces exerted against the column structure.

8 Claims, 6 Drawing Figures

OFFSHORE PLATFORMS

This invention relates to support structures for offshore platforms, such as drilling platforms, and in particular concerns a support structure for an offshore platform which is suitable for use in relatively deep water, e.g. of 600 ft. or more. The invention also relates to offshore structures embodying a platform and a support structure according to the invention.

With the discovery of oil under the bed of the North Sea, much time has been devoted to the designing of offshore drilling and other platforms and their support structures which are suitable for operation in this particular stretch of water, which is notorious for its widely varying conditions.

One form of offshore structure in use, includes a buoyant substructure held submerged under the water by being tied to the ocean floor by tie ropes, wires or the like. The platform proper is mounted on the substructure on legs so as to lie clear of the surface of the water. This structure has the disadvantage that it can break loose in the event of breakage of the tie ropes and become unstable, and, furthermore, as its stability depends upon a buoyant substructure, its stability will, we feel, be seriously affected due to water currents and wave motions in high seas.

The present invention seeks to provide an offshore platform support structure which stands in the sea bed, but which is capable of yielding under the action of wave motions to a predetermined extent in order to prevent damage from being imparted thereto in high seas.

In accordance with the invention, an offshore platform support structure comprises a column structure for standing on the sea bed, and being in at least two sections which are relatively tiltable in a plane or planes which is or are transverse to the column axis by the sections being located one relative to the other by means defining circumferentially arranged tilting axes about which the sections are relatively tiltable, and including yieldable tensioning means urging the sections axially together and resisting said relative tilting.

Preferably, the said means comprises circumferentially arranged knuckle type joints.

Preferably also, each pair of circumferentially adjacent joints defines an axis about which the sections are relatively tiltable.

Preferably also, there are three column sections, a lower section, an intermediate section and an upper section, the lower section and intermediate section being located one relative to the other by means so as to be tiltable as indicated above, and the intermediate section and upper section being relatively tiltable as indicated above, the tilting axes between the lower and intermediate sections being angularly offset relative to the axes of relative tilting between the intermediate and upper sections.

Preferably, there are three ball and socket joints defining the knuckle type joints between the lower section and the intermediate section and three similar joints between the intermediate section and upper section.

Alternatively, the joints may be defined by straight ribs lying in straight bar sockets and adapted to knuckle therein as the relative tilting takes place.

The invention also provides an offshore structure comprising a support structure and an offshore platform mounted thereon.

An embodiment of the present invention will now be described, by way of example, with reference to the accompanying diagrammatic drawings, wherein.

Figure 1:
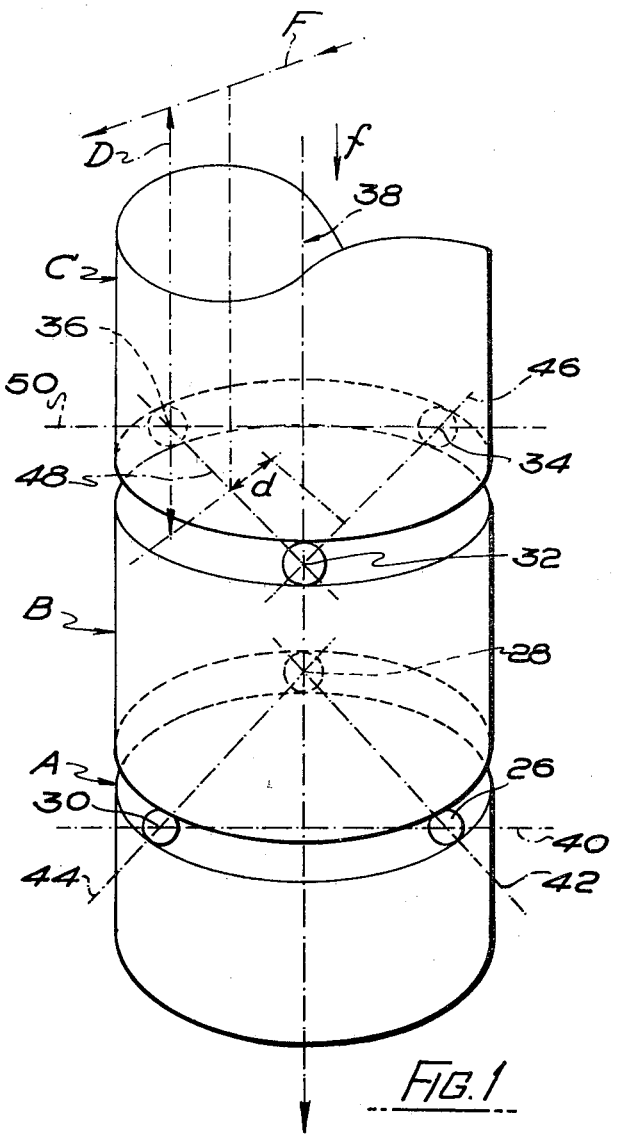
FIG. 1 is a perspective view illustrating the geometry of the platform supporting structure.
Figure 2:
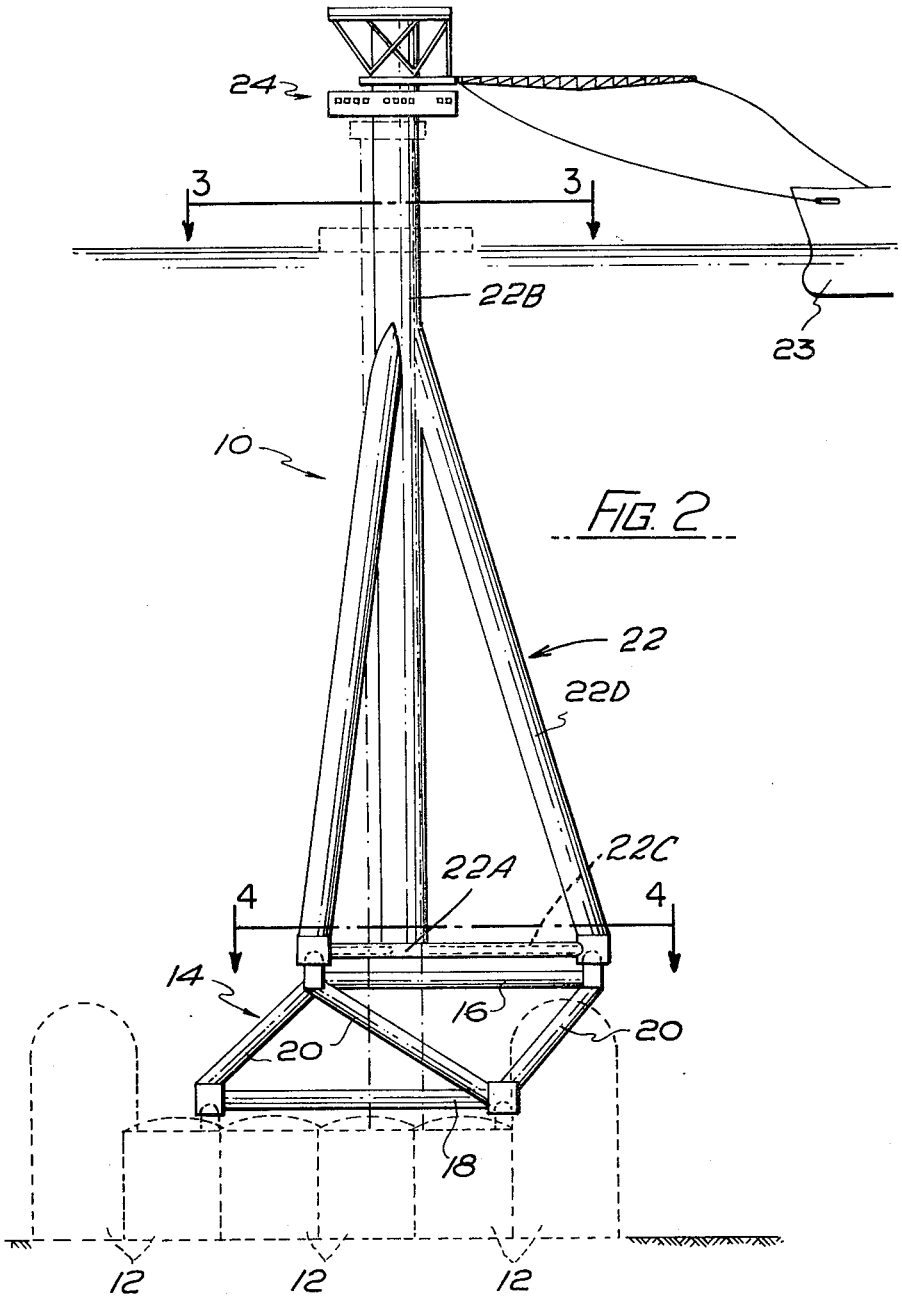
FIG. 2 is a side view of the platform and its supporting structure.
Figure 3:
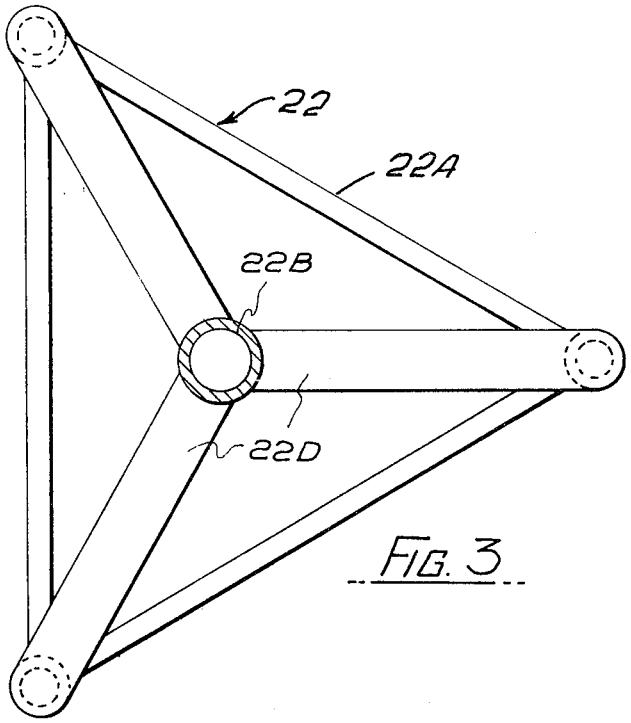
FIG. 3 is a section taken along the line 3—3 of FIG. 2.
Figure 4:
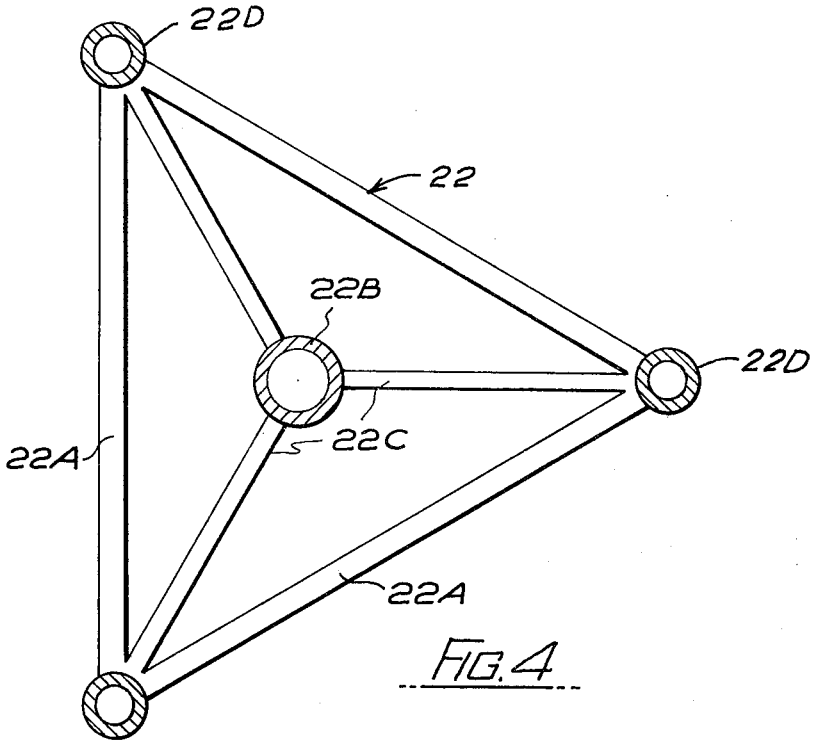
FIG. 4 is a section taken along the line 4—4 of FIG. 2.

Referring to the drawings, an offshore structure 10, which may be a drilling or service structure or the like, includes an upright column when in the in-use position. The column essentially is three sections, namely a lower section defined by base storage tanks 12, an intermediate section 14 made up of two heavy triangular frames 16 and 18 which are spaced apart by axially inclined braces 20, and an upper section 22 which is in the form of a triangular frame 22A, a cylindrical central spine 22B, brace rods 22D and support bars 22C. On top of section 22 is a platform structure 24 on which the appropriate derricks, buildings, tanks and the like, as the case requires, will be mounted. The drawings show platform 24 serving for the filling of a tanker 23 with oil.

The present invention is concerned with the facility of the upper section of the structure to move as a result of excessive wave loading thereon, and to this end the lower section and intermediate section are interconnected by knuckle type joints as are the intermediate section and upper section. These joints are in transverse planes, and are designed to enable relative tilting between the sections as will be explained subsequently with reference to FIG. 1. Essentially, each joint is in the form of a ball and socket arrangement and the joints between each pair of adjacent sections are spaced circumferentially of the column. In the example described, the three joints between each pair of adjacent sections are disposed at 120° intervals, and one set of joints is equi-angularly displaced by 60° relative to the other set. This arrangement gives the column freedom of tilting movement in six possible directions as will be explained with reference to FIG. 1.

The weight of the intermediate and upper sections keep these sections firmly seated on the knuckle joints, but in addition the sections are loaded axially together by tensioning means in this case in the form of heavy duty ropes, wires or the like which are tensioned between the underside of the platform structure 24 and the base tanks 12, the ropes lying outside spine 22B but having their centre of action lying on the centre of the column. These ropes may be of parafil material, so as to be capable of yielding as will now be explained.

Figure 5:
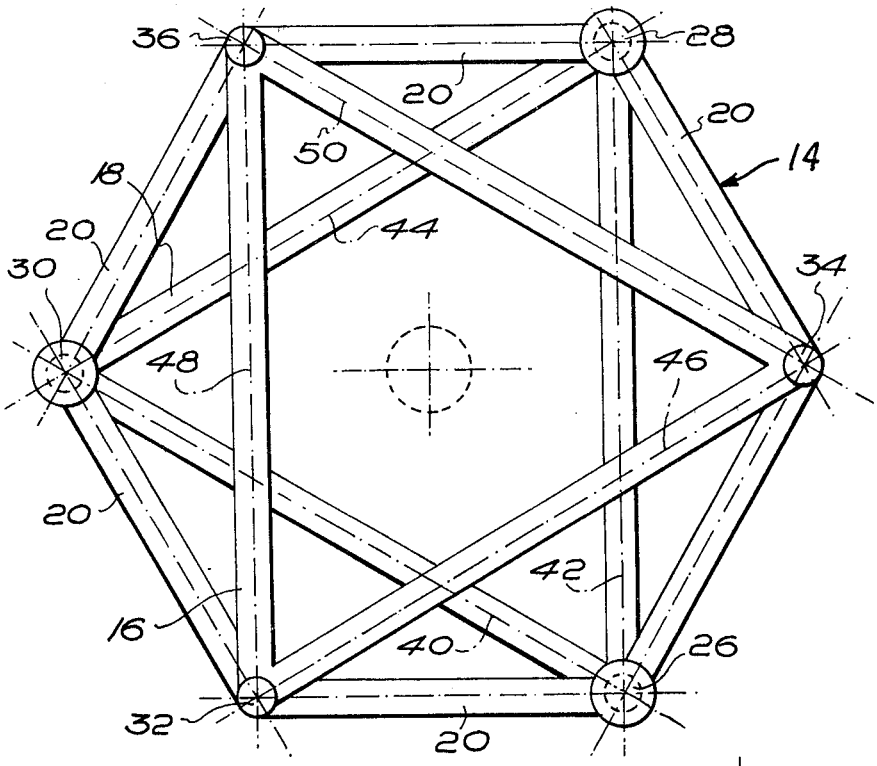
FIG. 5 is a top diagramatic plan view of intermediate section 14.
Figure 6:
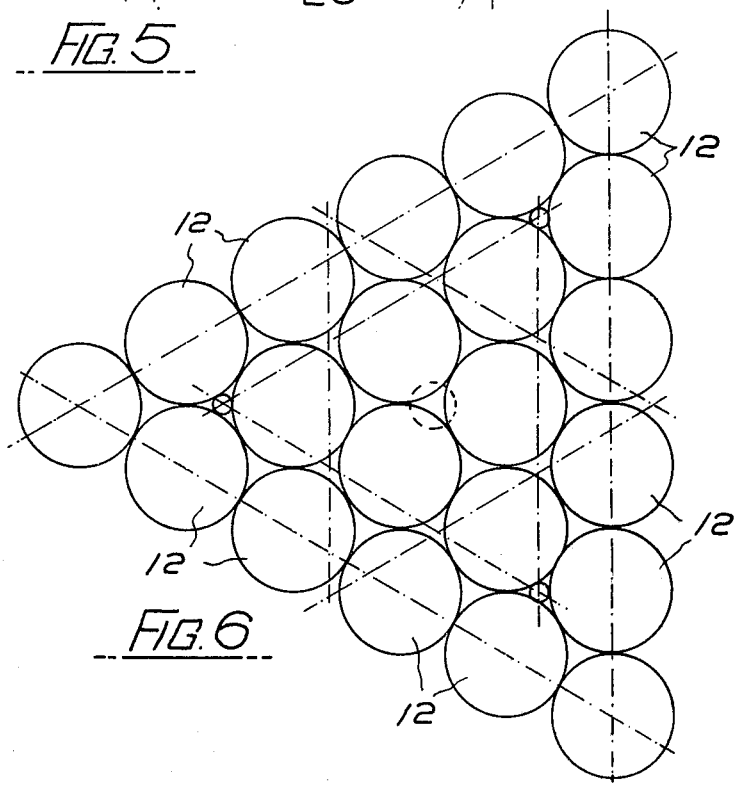
FIG. 6 is a top diagramatic plan view of the lower section defined by the base storage tanks 12.

Referring now to FIG. 1, the lower intermediate and upper sections are represented by references A, B and C and are illustrated in the interests of simplicity to be simply cylindrical structures. The three knuckle joints between sections A and B are indicated by balls referenced 26, 28 and 30. Likewise, the three knuckle joints between sections B and C are indicated by balls referenced 32, 34 and 36. The central line of action of the tension force applied by the ropes is indicated by reference 38. Each pair of circumferentially adjacent joints in each plane defines an axis passing through the centre of the joints about which the relevant sections are relatively tiltable. Thus, joints 26, 28 and 30 define tilting axes 40, 42 and 44, while joints 32, 34 and 36 define tilting axes 46, 48 and 50. Joints 26—36 and axes 40 — 50 are indicated clearly in FIG. 5.

In normal sea conditions the sections will not tilt relative to one another, but in the event of excessive sea loading being applied to the column, such as indicated by force F in FIG. 1, rather than the column suffering damage under this excess loading, it will tilt about one of the six axes referred to above, depending upon the direction of the force F. If it is assumed to be in the direction indicated in FIG. 1 the column will tilt about axis 48 in accordance with the equation.

$$F \times D = (f + w) \times d$$

where $f$ is the force imparted by the tension in the ropes, and $w$ is the weight acting centrally of the column and resisting the relative tilting movement.

This arrangement ensures that the structure will yield, which is desirable, under excess loading. In practice, because of the dynamics of wave motion, the tilting in a column of the height of 1,100 ft. will be extremely small, and the column will quickly return to its static position.

It is appreciated that the number of knuckle joints can be varied, as can the number of planes in which knuckle joints are contained and it will also be appreciated that it is desirable that the centre of force applied by the tensioning ropes should be on line 38 centrally of the column and certainly within the plan area contained by all six axes 40 to 50.

The sections of the structure will preferably be fabricated in metal but they may, or at least the intermediate and upper sections may, be constructed from reinforced concrete girders joined together to define a framework.

I claim:

1. An offshore platform support structure comprising a column structure for standing on the sea bed, and being in three sections which are relatively tiltable in at least one plane which is transverse to the column axis, said three column sections comprising a lower section, an intermediate section and an upper section, the lower section and intermediate section being located one relative to the other by first locating means so as to be relatively tiltable about circumferentially arranged tilting axes, and the intermediate section and upper section being located one relative to the other by second location means so as to be relatively tiltable about circumferentially arranged tilting axes, the tilting axes between the lower and intermediate sections being angularly offset relative to the tilting axes between the intermediate and upper sections.

2. A structure according to claim 1, wherein said first and second location means comprises knuckle type joints arranged circumferentially of the column structure.

3. A structure according to claim 2, wherein the joints are ball-and-socket knuckle type joints spaced circumferentially of the column structure, each circumferentially adjacent pair of joints defining one of said corresponding tilting axes.

4. A structure according to claim 2, wherein the joints are straight bar-and-socket joints, each joint being arranged chordwise relative to the structure axis and defining one of said corresponding tilting axes.

5. A structure according to claim 1, wherein there are three first said tilting axes between the lower and intermediate sections, said first tilting axes being arranged in the pattern of a first equilateral triangle, and there are three second said tilting axes between the intermediate and upper sections, said second tilting axes being arranged in the pattern of a second equilateral triangle, and said second equilateral triangle pattern is angularly offset relative to said first equilateral triangle pattern by 60°.

6. A structure according to claim 1, including yieldable tensioning means urging the sections axially together and resisting said relative tilting.

7. A structure according to claim 6, wherein the tensioning means comprises a plurality of reaches of parafil ropes extending centrally and lengthwise of the column structure.

8. A structure according to claim 1 further comprising an offshore platform on top of said upper section.

* * * * *